US011474447B2

(12) United States Patent
Cohen et al.

(10) Patent No.: US 11,474,447 B2
(45) Date of Patent: Oct. 18, 2022

(54) LIQUID ELECTRO-PHOTOGRAPHIC PRINTING TRANSFER

(71) Applicant: Hewlett-Packard Development Company, L.P., Spring, TX (US)

(72) Inventors: Lavi Cohen, Ness (IL); Asaf Shoshani, Ness (IL); Doron Schlumm, Ness (IL); Michael Vinokur, Ness (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/297,430

(22) PCT Filed: Dec. 17, 2018

(86) PCT No.: PCT/US2018/065988
§ 371 (c)(1),
(2) Date: May 26, 2021

(87) PCT Pub. No.: WO2020/131010
PCT Pub. Date: Jun. 25, 2020

(65) Prior Publication Data
US 2022/0050400 A1 Feb. 17, 2022

(51) Int. Cl.
*G03G 15/06* (2006.01)
*G03G 15/10* (2006.01)

(52) U.S. Cl.
CPC ..... *G03G 15/065* (2013.01); *G03G 15/104* (2013.01); *G03G 2215/0626* (2013.01)

(58) Field of Classification Search
CPC ..... G03G 17/10
See application file for complete search history.

(56) References Cited

U.S. PATENT DOCUMENTS 3,996,892 A 12/1976 Parker
4,266,328 A 5/1981 Harada et al.
(Continued)

FOREIGN PATENT DOCUMENTS

JP 57-111568 A 7/1982
JP 58113745 A * 7/1983
(Continued)

OTHER PUBLICATIONS

Burbage, Joseph et al. "The Effect of Magnetic Roller Field Uniformity on Print Quality in Electrophotography." International Conference on Digital Printing Technologies Oct. 18-23, 1998, Toronto, Ontario, Canada.

*Primary Examiner* — Leon W Rhodes, Jr.
(74) *Attorney, Agent, or Firm* — Fabian VanCott

(57) ABSTRACT

A liquid electro-photographic printing system, comprising: a binary ink developer assembly, a power supply arrangement, a switching arrangement, and a controller. The binary ink developer assembly includes a plurality of members defining a flow path for a printing fluid containing charged particles, the plurality of members including a first member and a second member that are arranged to generate an electric field therebetween, the first member having a plurality of segments. The power supply arrangement continuously provides a supply of voltages during a print operation, the voltages including a first voltage and a second voltage having a different voltage level from that of the first voltage. The switching arrangement switches the supply of voltages to the segments of the first member on an individual segment basis, to cause charged particles to be attracted to the first member in the individual segment when the first voltage is supplied to the individual segment and to cause charged particles to be repelled from the first member in the individual segment when the second voltage is supplied to the
(Continued)

individual segment. The controller to determine timing of when to switch the supply of voltages to the segments.

20 Claims, 9 Drawing Sheets

(56) References Cited

U.S. PATENT DOCUMENTS

| | | | | |
|---|---|---|---|---|
| 4,291,643 | A * | 9/1981 | Kobayashi | G03G 15/10 118/669 |
| 5,012,287 | A * | 4/1991 | Knapp | G03G 15/09 399/314 |
| 5,036,341 | A * | 7/1991 | Larsson | G03G 15/346 347/55 |
| 5,038,158 | A | 8/1991 | Ayers et al. | |
| 5,920,750 | A | 7/1999 | Wayman et al. | |
| 6,744,994 | B2 | 6/2004 | Yoshikawa et al. | |
| 8,023,846 | B2 * | 9/2011 | Tombs | G03G 15/0818 399/55 |
| 9,946,197 | B2 | 4/2018 | Schlumm et al. | |
| 10,416,587 | B2 * | 9/2019 | Ohazama | G03G 15/0216 |
| 2008/0304846 | A1 | 12/2008 | Tombs et al. | |

FOREIGN PATENT DOCUMENTS

| | | | | |
|---|---|---|---|---|
| JP | 2005077540 | | 3/2005 | |
| JP | 2007025693 | A * | 2/2007 | G03G 15/0815 |
| JP | 4065496 | B2 | 3/2008 | |
| JP | 4698503 | B2 | 6/2011 | |
| KR | 19990010695 | A * | 5/1999 | G03G 15/065 |
| WO | WO-2013058905 | | 4/2013 | |
| WO | WO-2017030580 | A1 * | 2/2017 | G03G 15/11 |
| WO | WO-2018177539 | A1 * | 10/2018 | G03G 15/0216 |

* cited by examiner

LIQUID ELECTRO-PHOTOGRAPHIC PRINTING TRANSFER

BACKGROUND

Liquid electro-photographic (LEP) printing, sometimes also referred to as liquid electrostatic printing, uses liquid toner to form images on paper, foil, or another print medium. The liquid toner, which is also referred to as ink, includes particles dispersed in a carrier liquid. The particles have a color which corresponds to the process colors that are to be printed in accordance with a used color model such as, for example, CMYK.

BRIEF DESCRIPTION OF DRAWINGS

Non-limiting examples will now be described with reference to the accompanying drawings, in which.

DETAILED DESCRIPTION

A LEP printing process may involve selectively charging/discharging a photoconductor, also referred to as photo imaging plate, PIP, to produce a latent electrostatic image. For example, the PIP may be uniformly charged and selectively exposed to light to dissipate the charge accumulated on the exposed areas of the photoconductor. The resulting latent image on the photoconductor may then be developed by applying a thin layer of charged toner particles to the photoconductor.

The charged toner particles may adhere to negatively charged or discharged areas on the photoconductor (discharged area development DAD) or to positively charged areas on the photoconductor (charged area development CAD), depending on the charge of the toner particles and the charge accumulated on the PIP surface. The image on the PIP formed by the charged toner particles adhering to the PIP may then be transferred to a charged and heated intermediate transfer member, ITM, which transfers the print medium.

Figure 1:
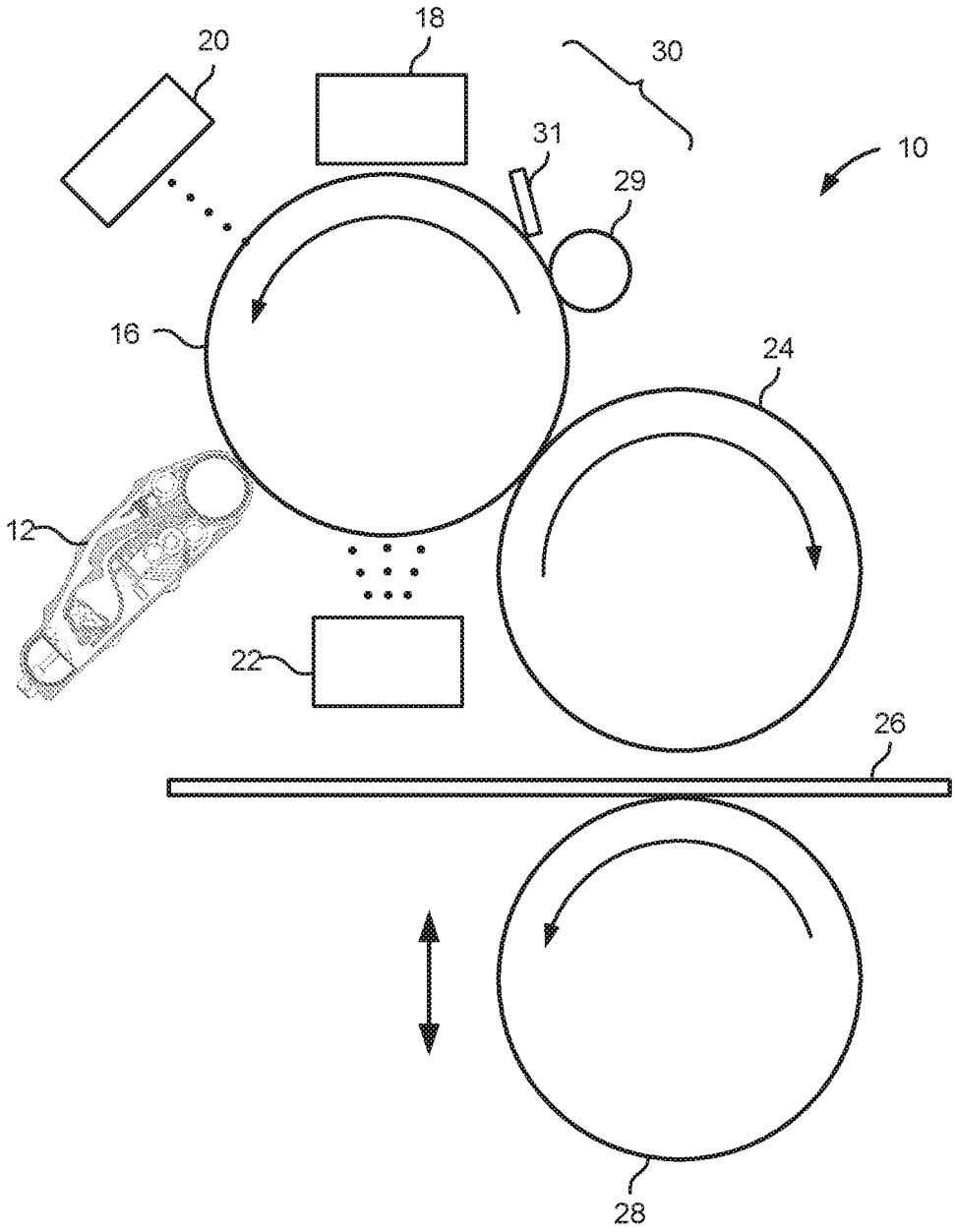
FIG. 1 is a schematic cross-sectional view of an LEP printing system, according to an example.

FIG. 1 is a schematic cross-sectional view of an LEP printing system 10, according to an example. The system 10 comprises a BID assembly 12 (shown in greater detail in FIG. 2) which, during operation, may feed charged particles suspended in a non-conductive carrier fluid, e.g., an imaging oil, from an ink inlet 14 to the PIP 16. The carrier fluid may be a fluid in which polymers, particles, colorant, charge directors and other additives can be dispersed to form a liquid electrostatic ink or electrophotographic ink. As shown in FIG. 1, the PIP 16 may comprise a thin film of photoconductive material wrapped around the cylindrical surface of a rotating drum. In another example, a photoconductive film may be provided on a belt, band, web, or platen which is movable relative to the BID assembly 12. During operation, a uniform electrostatic charge may be applied to an area on the surface of the photoconductive material passing by a charging station 18. The charging station 18 may comprise, for example, a scorotron, a charge roller, or another charging device.

To provide for selectively charged surface areas, the uniformly charged area may pass by a selective discharging station 20. The selective discharging station 20 may selectively expose the surface of the photoconductive material to light, for example. As a result, the charge on the exposed areas may dissipate, thereby providing for discharged areas. For instance, the surface of the photoconductive material may be selectively discharged by a laser or another suitable photo imaging device. Hence, the surface of the photoconductive material passing by the selective discharging station 20 may be divided into charged and discharged areas, wherein a voltage differential between the charged and the discharged areas may, for example, be more than 200 V, more than 400 V, or more than 600 V, or in the range of 200 V to 1000 V. The charged and discharged areas may correspond to a pixel pattern of an image to be printed.

The latent image on the PIP 16, carried on the surface areas having passed the selective discharging station 20, may then be developed by transferring charged particles onto the PIP 16. In the case of DAD, the charged particles may adhere to the discharged areas of the PIP 16 while being repelled from the charged areas of the PIP 16. In the case of CAD, the charged particles may adhere to the charged areas of PIP 16 while being repelled from the discharged areas of the PIP 16. In either case, a pattern of charged particles in a layer of uniform particle concentration may be selectively formed on areas on a surface of the PIP 16. The residual charge may then be removed from the PIP 16, e.g., by exposing the PIP 16 to light of an LED lamp or another discharging device 22.

The formed layer may then be transferred to the ITM 24. As shown in FIG. 1, the ITM 24 may, for example, comprise a chargeable blanket wrapped around a rotating drum. However, the ITM 24 may take any suitable configuration including, for example, a belt, band, web, or platen. The blanket may be heated to fuse charged particles adhering to the ITM 24. The resulting layer of fused particles may be transferred from the ITM 24 to a print medium 26. The print medium 26, which may be paper, foil, or any other medium, may be delivered to the system 10 as a continuous web, e.g., dispensed from a roll, or as individual sheets and pass through a nip between the ITM 24 and a pressure roller 28. The pressure roller 28, which is also referred to as an impression cylinder (IMP), may press the print medium 26 in the nip against the layer on the ITM 24 surface such that the layer may be cooled down and adhere to the print medium 26.

After transferring the layer onto the ITM 24, ink particle residue may be removed from surface areas of the PIP 16 which pass by a cleaning station. For example, the cleaning station 30 may comprise a cleaning roller 29 and a wiper blade 31. After passing the cleaning station 30, a uniform electrostatic charge may be re-applied to the PIP 16 area passing the charging station 18 to start a new cycle. In each cycle, a process color may be printed by transferring charged particles of the respective color onto the PIP 16. If an image is printed by printing more than a single process color, multiple color layers may be transferred one after the other to the ITM 24. The ITM 24 may collect the color layers and transfer the full image onto the print medium 26, or the color layers may be transferred one after the other onto the print medium 26. In the first case, the pressure roller 28 may become active after the color layers are collected on the ITM 24, as indicated by the vertical arrow in FIG. 1.

Figure 2:
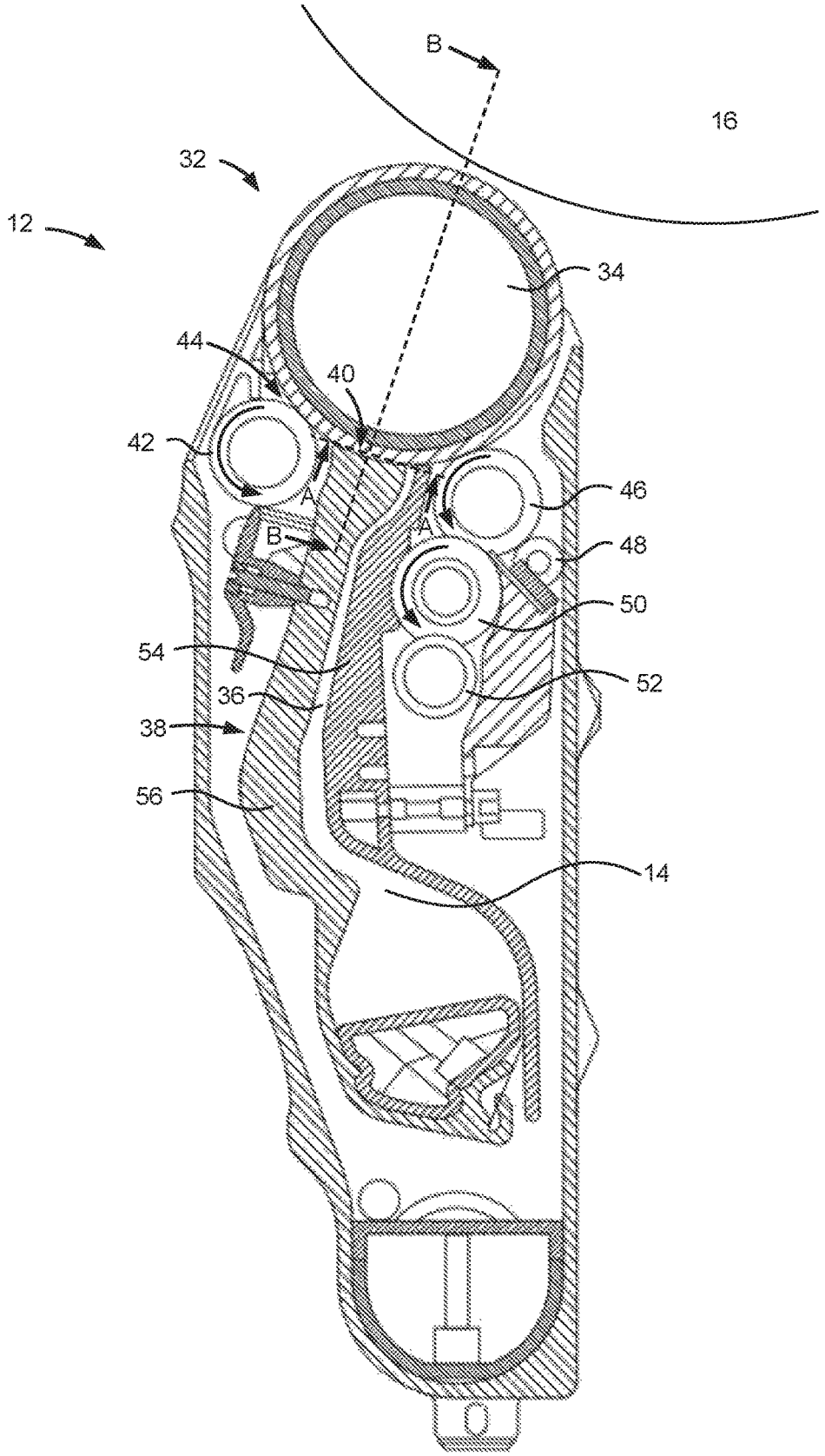
FIG. 2 is a schematic cross-sectional view of a binary ink developer, BID, assembly, according to an example.

FIG. 2 is a schematic cross-sectional view of a BID assembly 12, according to an example. The BID assembly 12 comprises a transfer device 32, which when driven during operation, may transfer an ink composition from the ink inlet 14 onto the PIP 16. The BID assembly 12 may comprise an electrode arrangement 38, forming an ink supply path 36 between a main electrode 56 and a back electrode 54 of the electrode arrangement 38. The transfer device 32 may comprise a developer roller 34 which, during operation, may receive the charged particles from the ink inlet 14 via the ink supply path 36. The ink composition may include particles and may contain a charge director which is attached to the particles so that they may react to an electrostatic field. When passing the ink composition between the electrode arrangement 38 and to the developer roller 34, if a sufficient potential is applied between the electrode arrangement 32 and the developer roller 34, the ink particles are charged and adhere to the developer roller 34. In order to form a dense particle layer on the developer roller 34, the BID assembly 12 includes the electrode arrangement 38 which generates an electric field attracting the charged particles to the surface of the developer roller 34. Ink from the ink supply path 36 passes through a gap or channel 40 between the electrode arrangement 38 and the developer roller 34. The gap or channel 40 may have a width perpendicular to a flow direction of the ink, in an axial direction of the developer roller, wherein the width may span a nominal printing width of the system 10 and substantially correspond to the width of the developer roller 34 (in the direction of its rotational axis).

As the electrode arrangement 38 and hence ink particles passing the electrode arrangement 38 may be charged to a different voltage than the developer roller 34, an electric field may be generated which is directed in a radial direction towards the developer roller 34, and which attracts the charged particles to the surface of the developer roller 34 and increases the particle density in an ink layer on the surface of the developer roller. Furthermore, the BID assembly 12 may comprise a squeegee roller 42. The squeegee roller 42 may exert mechanical and electrostatic forces onto the charged particles adhering to the surface of the developer roller 34 when urging the charged particles through the nip 44 formed between the squeegee roller 42 and the developer roller 34. Accordingly, the squeegee roller 42 may be charged to a different voltage than the developer roller 34 to increase a density of the charged particles layer on the developer roller 34.

After transferring charged particles from the charged particles layer onto the surface of the PIP 16, the remaining charged particles may be removed from the developer roller 34. For example, FIG. 2 shows an example where a cleaner roller 46, which may be electrically charged, removes the remaining charged particles from the developer roller 34. A wiper blade 48 and a sponge roller 50 may be used to remove the charged particles from the cleaner roller 46 and remix the removed charged particles with carrier liquid fed from the ink supply path 36. For instance, a squeezer roller 52 may apply pressure to portions of a surface of the sponge roller 52 to squeeze the particles dispersed in the carrier liquid out of the pores of the sponge.

Thus, the members of the BID assembly 12 including the developer roller 34, the electrodes 54, 56, and the squeegee roller 42 define a flow path for the printing liquid. The wording 'flow path' should be understood to mean the path or route which the printing liquid takes within at least a part of the liquid electrophotography apparatus and the printing liquid may flow between the members (for example, via an electric field) and be transferred between the members (for example, through physical contact between the members.

Figure 3:
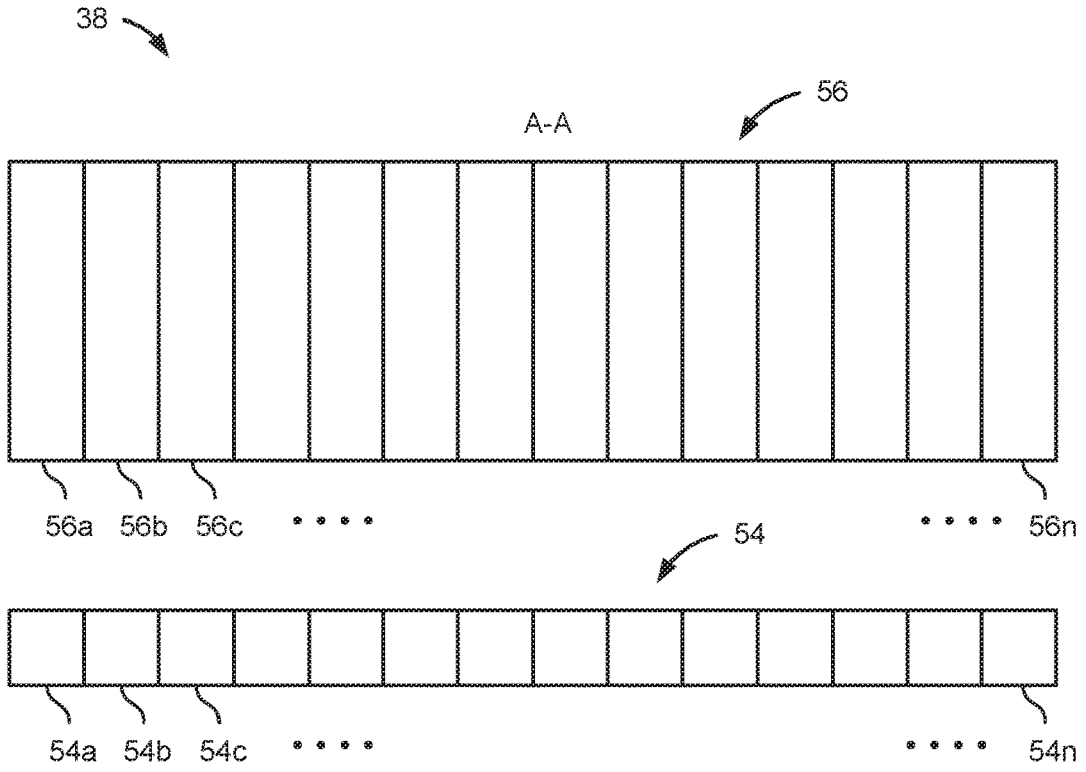
FIG. 3 is a schematic longitudinal section view of an electrode arrangement, along A-A in FIG. 2, according to an example.

FIG. 3 is a schematic longitudinal sectional view through the electrode arrangement 38 in FIG. 2, according to an example, showing the main electrode 56 and the back electrode 54. Both of the main electrode 56 and the back electrode 54 may comprise a number of ink charging electrodes segments 54*a*-54*n* and 56*a*-56*n* which respectively are arranged adjacent to each other along a direction parallel to the width direction of the gap or channel 40 (perpendicular to the drawing plane) and which are electrically insulated from each other. The insulation of the electrode segments allows individually controlling an electric potential of each electrode segments 54*a*-54*n* and 56*a*-56*n*. As shown in FIG. 3, the electrode segments 54*a*-54*n* and 56*a*-56*n* are of substantially same width (in a direction parallel to the width direction of the gap or channel 40), although in other examples the electrode segments 54*a*-54*n* and 56*a*-56*n* may have different widths. Opposite electrodes segments of the two electrodes 54, 56, such as segments 54*a*, 56*a*, segments 54*b*, 56*b*, etc., may be charged to identical voltage levels to prevent cross-sectional electrostatic fields.

Figure 4:
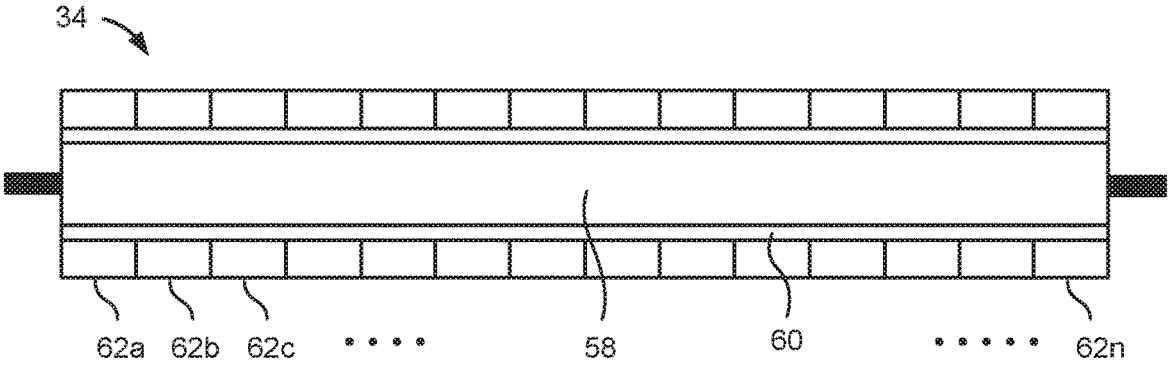
FIG. 4 is a schematic longitudinal section view of a developer roller, according to an example.

FIG. 4 is a schematic longitudinal sectional view of a developer roller 34, according to an example. The developer roller 34 may comprise a hollow cylindrical core 58. The core 58 may be manufactured from any suitable material, such as, e.g., metal, plastic and the like. In case of a conductive core 58, the core 58 may further be provided with an insulating layer 60. The developer roller 34 may also include a shaft and gear arrangement connected to the core 58, which may be operatively associated with a drive assembly (not shown) of the system 10. The drive assembly may include mating gears to effect rotational movement of the developer roller 34 during a printing operation in which the PIP 16 is rotated to have the same surface speed direction in the nip as the developer roller 34, at the same or at a different speed. For example, there may be a small surface speed difference between the PIP and the developer roller.

A plurality of conductive developer roller segments 62*a*-62*k* may be arranged on the periphery of the developer roller 34. If the developer roller 34 includes a conductive core, an insulating layer 60 will be provided between the core and the conductive developer roller segments 62*a*-62*n*. Alternatively, the core 58 can be made of a non-conducting material. The conductive developer roller segments 62*a*-62*n* may be ring segments or partial ring segments of a conductive and electrically chargeable material, for example. For instance, the developer roller segments 62*a*-62*n* may be made of a conductive material, e.g., metal such as, for example, aluminum, stainless steel, and combinations thereof, or may be made of polymeric material incorporating additives such as metal particles, ionic charged particles, carbon black, graphite, etc., and combinations thereof. Moreover, flexible conductors may be used for connecting the developer roller segments 62*a*-62*n* to a power source and control circuit (not shown). The developer roller segments 62*a*-62*n* are electrically isolated from each other.

Gaps between the developer roller segments 62*a*-62*n* (in the width direction) may be filled with spacer rings made from an insulating material. The gaps may be small enough, e.g., below 3 mm or below 1 mm, e.g. between 25 μm and 1 mm, to avoid large field variations and/or an electric field breakdown between the developer roller segments 62*a*-62*n*. The developer roller segments 62*a*-62*n* may be covered with a layer made from an insulating material. The insulating material may be any kind of suitable material, with polyurethane being one possible option. As shown in FIG. 4, the developer roller segments 62*a*-62*n* may have different widths (in a direction parallel to the width direction of the gap or channel 40), although developer roller segments 62*a*-62*n* of substantially a same width may also be used in another example. Moreover, the widths of the developer roller segments 62*a*-62*n* may correspond to or match with the widths of the electrode segments 54*a*-54*n* and 56*a*-56*n*, as can be recognized from comparing FIG. 3 and FIG. 4, although the drawings are not necessarily drawn to scale.

Furthermore, whereas electrodes segments 54*a*-54*n* and 56*a*-56*n* and developer roller segments 62*a*-62*n* can be provided to correspond to each other in a single system 10, the disclosure is not intended to be limited to such a configuration. Rather, the system 10 may comprise the electrode arrangement 38 of FIG. 3 in combination with a developer roller 34 having a continuous surface layer, or the system 10 may comprise an electrode arrangement 38 having a single electrode pair 54, 56, in combination with a segmented developer roller 34 as shown in FIG. 4. In a configuration where a segmented electrode pair 54, 56 and a segmented developer roller 34 are used, respective segments are aligned to each other to avoid undefined cross-sectional fields.

Figure 5:
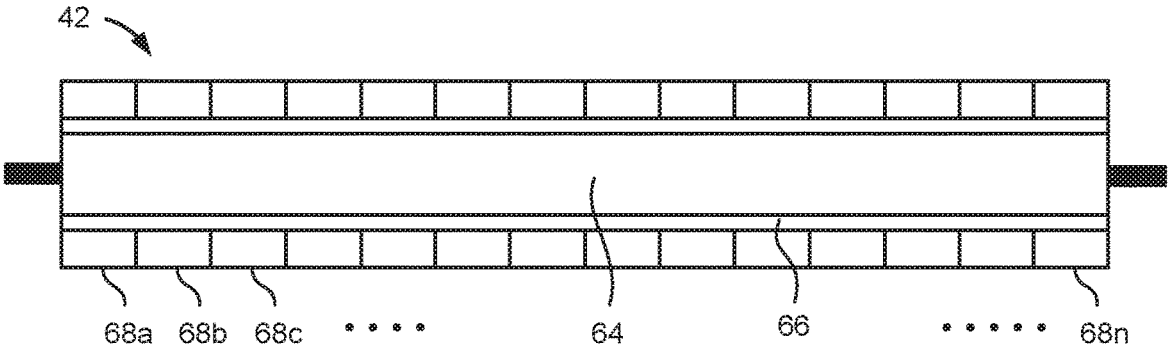
FIG. 5 is a schematic longitudinal section view of a squeegee roller, according to an example.

FIG. 5 is a schematic longitudinal section view of a squeegee roller 42, according to an example. The squeegee roller 42 may comprise a hollow cylindrical core 64. The core 64 may be manufactured from a material which matches to the material of the developer roller 34 core 58. In case of a conductive core 58, the core 58 may further be provided with an insulating layer 66. The squeegee roller 42 may also include a shaft and gear arrangement connected to the core 64, which may be operatively associated with the drive assembly (not shown) of the system 10. The drive assembly may include mating gears to effect rotational movement of the squeegee roller 42 during a printing operation in which the squeegee roller 42 is rotated to have the same surface speed direction in the nip as the developer roller 34, at the same or at a different speed. For example, there may be a small surface speed difference between the squeegee roller 42 and the developer roller 32.

On the insulating layer 66, or on a core 64 made of a non-conducting material, a plurality of squeegee roller segments 68*a*-68*n*, such as ring segments or partial ring segments, may be arranged. For instance, the squeegee roller segments 68*a*-68*n* may be made of a conducting and electrically chargeable material, e.g., metal such as, for example, aluminum, stainless steel, and combinations thereof. The squeegee roller segments 68*a*-68*n* may also comprise a core of non-conducting material coated or covered with a layer of a conductive material layer, e.g., a layer of polymeric material incorporating additives such as metal particles, ionic charged particles, carbon black, graphite, etc., and combinations thereof. Moreover, flexible PCBs maybe used for wiring.

Gaps between the squeegee roller segments 68*a*-68*n* (in the width direction) may be filled with spacer rings made from an insulating material. The gaps may be small enough, e.g., below 3 mm or below 1 mm, e.g. between 25 μm and 1 mm, to avoid large field variations and/or an electric field breakdown between the squeegee roller segments 68*a*-68*n*. As shown in FIG. 5, the squeegee roller segments 68*a*-68*m* may have different widths (in a direction parallel to a direction of rotation of the squeegee roller 42) although squeegee roller segments 68*a*-68*n* of substantially a same width may also be used. Moreover, the widths of the squeegee roller segments 68*a*-68*n* correspond or match to the widths of the electrode segments 54*a*-54*k* and 56*a*-56*n* as can be seen from FIG. 3 and FIG. 5 and/or correspond or match to the widths of the developer roller segments 62*a*-62*n* as can be seen from FIG. 4 and FIG. 5.

In examples, rather than having a uniform electric field in the gap or channel 40 between the main electrode 56 and the developer roller 34 along the width of the developer roller 34, or over the entire (nominal) printing width (which may correspond to around the width of the PIP 16), the electric field may be individually controllable (in the width direction) on the basis of segments along the width of the gap or channel 40. The direction of the electric field in this gap or channel is in the radial direction of the developer roller if all of the segments of the electrode and the developer roller correspond. For instance, to individually control a particle concentration or density of a charged particles layer on developer roller segments 62*a*-62*n* along a direction parallel to an axis of rotation of the developer roller 34, corresponding electrode segments 54*a*-54*n*, 56*a*-56*n* of the BID and segments 62*a*-62*n* of the developer roller 34 and/or corresponding segments 62*a*-62*n* of the developer roller 34 and segments 68*a*-68*n* of the squeegee roller 42 may be charged to different voltage levels. Corresponding segments of the electrodes 54, 56, the developer roller 34 and/or the squeegee roller 42 may be located opposite to each other. For example, one of the pairs of ink charging electrode segments 56*a*-56*n*, 54*a*-54*n* of the electrode arrangement 38 and a corresponding one of the developer roller segments 62*a*-62*n* of the developer roller 34, and/or one of the developer roller segments 62*a*-62*n* and a corresponding one of the squeegee roller segments 68*a*-68*n* may be aligned and located opposite to each other. In such cases, the direction of the electric field in the gap is in a radial direction of the developer roller 34. Thus, charged particles may be repelled from some surface segments of the developer roller 34 while being attracted or drawn to other surface segments of the developer roller 34.

In an example, a lower voltage in a range of 300 V to 600 V may be applied to a first electrode segment pair, whereas a higher voltage in a range of 1000 V to 1500 V may be applied to a second electrode segment pair. Moreover, a higher voltage in a range of 600 V to 1000 V may be applied to a first developer roller segment (corresponding to the first electrode segment pair), whereas a lower voltage in a range of 300 V to 600 V may be applied to a second developer roller segment (corresponding to the second electrode segment pair). The PIP 16 may be uniformly charged to 1000 V and then selectively discharged according to a pattern of pixels to be printed, wherein discharged areas may be at about zero (0) V or may be charged up to 100 V. If a non-segmented squeegee roller 42 is used, a uniform voltage in a range of 800 V to 1100 V may be applied to the squeegee roller 42. If a segmented squeegee roller 42 is used, a first squeegee roller segment (corresponding to the first developer roller segment) may be charged at a reduced voltage in a range of 300 V to 600 V, and another segment (corresponding to the second developer roller segment) may be charged at the higher voltage of 800 V to 1100 V. In the above example, the first electrode segment pair is charged to provide a non-developing area of the developer roller 34, and the second electrode segment pair is charged to provide a developing area of the developer roller 34.

Figure 6:
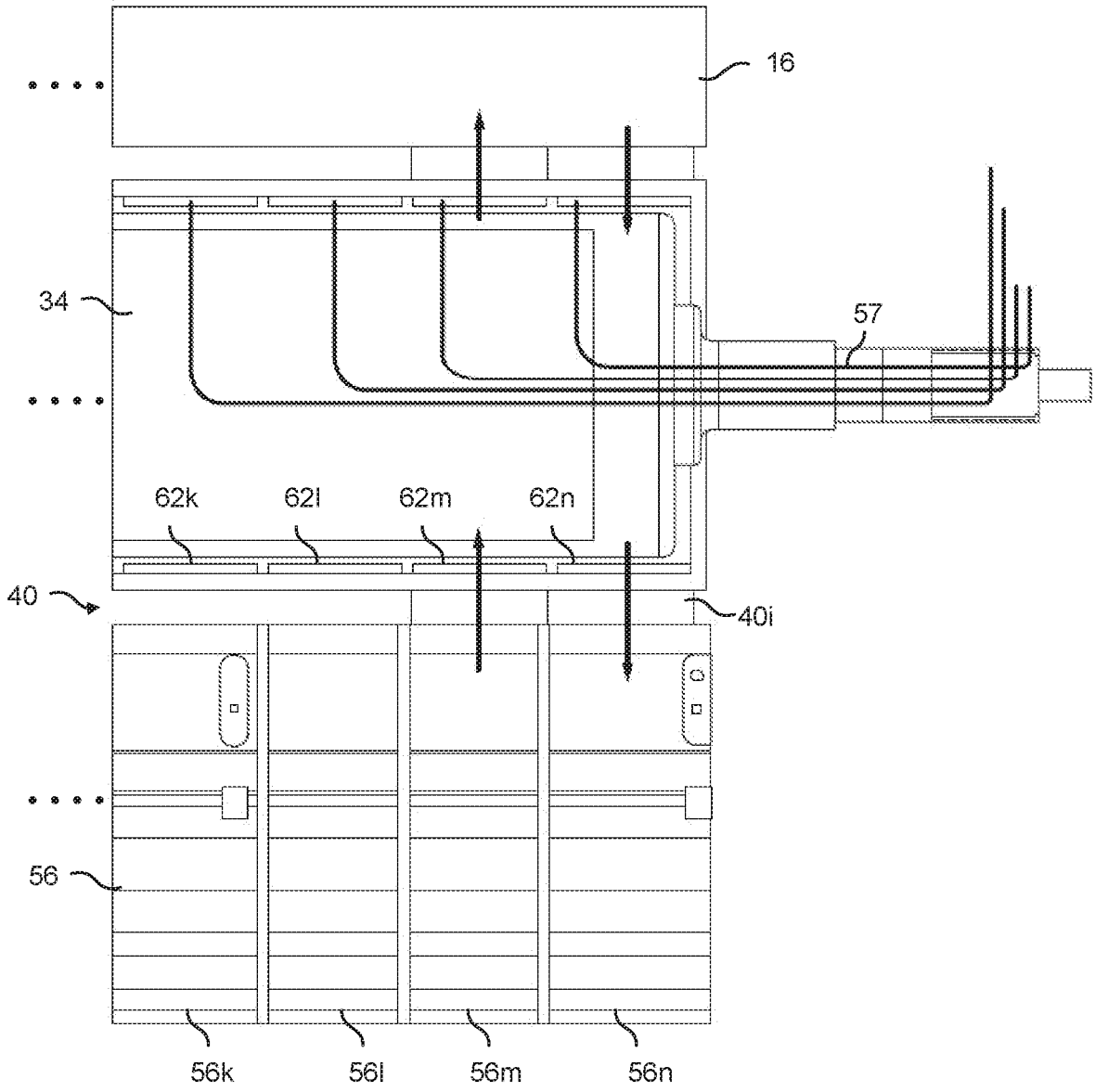
FIG. 6 is a schematic longitudinal section view of part of the main electrode of the electrode arrangement of FIG. 3 and part of the developer roller of FIG. 4 during a process involving transferring charged particles to the PIP, according to an example.

For example, with reference to FIG. 6, which is a detailed, cross-sectional view, along line B-B in FIG. 2, the lower voltage in the range of 300 V to 600 V may be applied to main electrode segment 56*n* and back electrode segment 54*n* (not shown), whereas the higher voltage in the range of 1000 V to 1500 V may be applied to main electrode segment 56*m* and back electrode segment 54*m* (not shown). Moreover, the higher voltage in the range of 600 V to 1000 V may be applied to segment 62*n* of the developer roller 34, whereas the lower voltage in the range of 300 V to 600 V may be applied to segment 62*m* of the developer roller 34. The PIP 16 is uniformly charged to 1000 V. The voltages can be supplied to individual segments by respective voltage lines. For example, voltage lines 57 to the metal parts of the developer roller 34 can be used to supply voltage to the segments of the developer roller 34 on an individual basis. This will be described in more detail later with reference to FIGS. 7-14. The directions of the resulting electric fields are indicated by arrows in FIG. 6. Thus, the electrode segment pair 54*n*, 56*n* is charged to provide a non-developing segment 62*n* of the developer roller 34 and the electrode segment pair 54*m*, 56*m* is charged to provide a developing segment 62*m* of the developer roller 34. In other words, charged particles in the gap or channel 40 would be drawn to the developer roller segment 62*m* and then to a discharged area of the PIP 16. Thus, charged particles may be repelled from some surface segments of the developer roller 34 while being attracted or drawn to other surface segments of the developer roller 34.

This allows controlling a width of a charged particles layer of uniform density on the surface of the developer roller 34 on an individual segment basis, compared to having a charged particles layer of uniform density extending over the entire width of the developer roller 34. It is hence possible to generate a charged particles layer in selected segments of the developer roller 34, when compared to the entire width of the developer roller 34. For example, if an area of the PIP 16 is not actively involved in the printing process, a charged particle density may be reduced in corresponding developer roller surface segment of the developer roller 34, which otherwise might unintentionally pressure-force charged particles onto the PIP 16. It is also possible to generate multiple spaced charged particles layers across the segments. A similar effect can be achieved, or the effect of selectively charging the electrode segments 54*n*, 56*n* and developer roller segment 62*n* can be enhanced, by analogously controlling the voltage level of the squeegee roller segment 68*n* of the squeegee roller 42. The squeegee roller 42 may account for about 30% of the density increase of the ink particles in the imaging oil.

Figure 7:
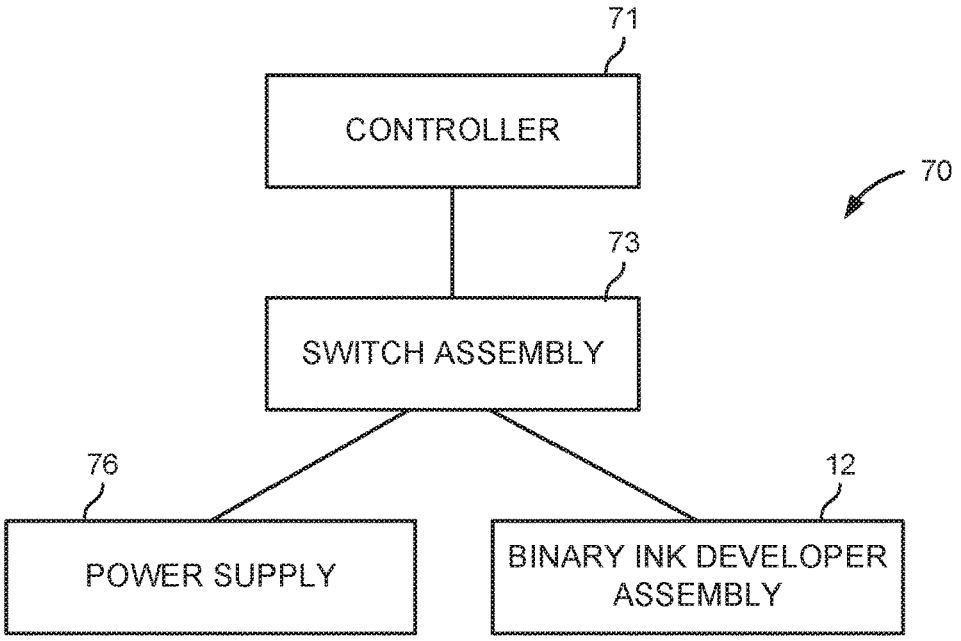
FIG. 7 schematically illustrates parts of an LEP printing system, according to another example.

FIG. 7 schematically illustrates a LEP printing system 70 comprising a BID assembly 12 (for example as shown in FIGS. 1 and 2), a controller 71, a switch assembly 73, and a power supply 76. Other components of the LEP printing system 10 of FIG. 1 may also be included in the LPE printing system 70 of FIG. 7. For simplicity, and unless otherwise noted, in the following description it is assumed that one of the members of the BID assembly 12 is segmented. For example, the developer roller 34 can be segmented in the manner described with reference to FIGS. 4 and 6. However, it will be appreciated that the principles described below are also applicable to configurations in which a different member of the BID assembly 12 is segmented, such as the main and back electrodes 54, 56 or the squeegee roller 42. Furthermore, the principles also apply to configurations in which two or more members of the BID assembly 12 are segmented such as the developer roller 34 and the main and back electrodes 54, 56. Different combinations of segmented members are also possible of course.

As shown in FIG. 7, a power supply 76 is electrically connected to the binary ink developer assembly 12. The wording "electrically connected" means that two elements are in electrical contact, but can be connected over an intermediate element, hence they need not be directly connected. For example, the power supply 76 may be electrically connected to the BID assembly 12, and in particular to the segments 62 of the developer roller 34 as shown in FIG. 6, via a switch assembly 73. Any suitable electrical connection between the power supply 76 and the segments 62 of the developer roller 34 may be provided.

Figure 8:
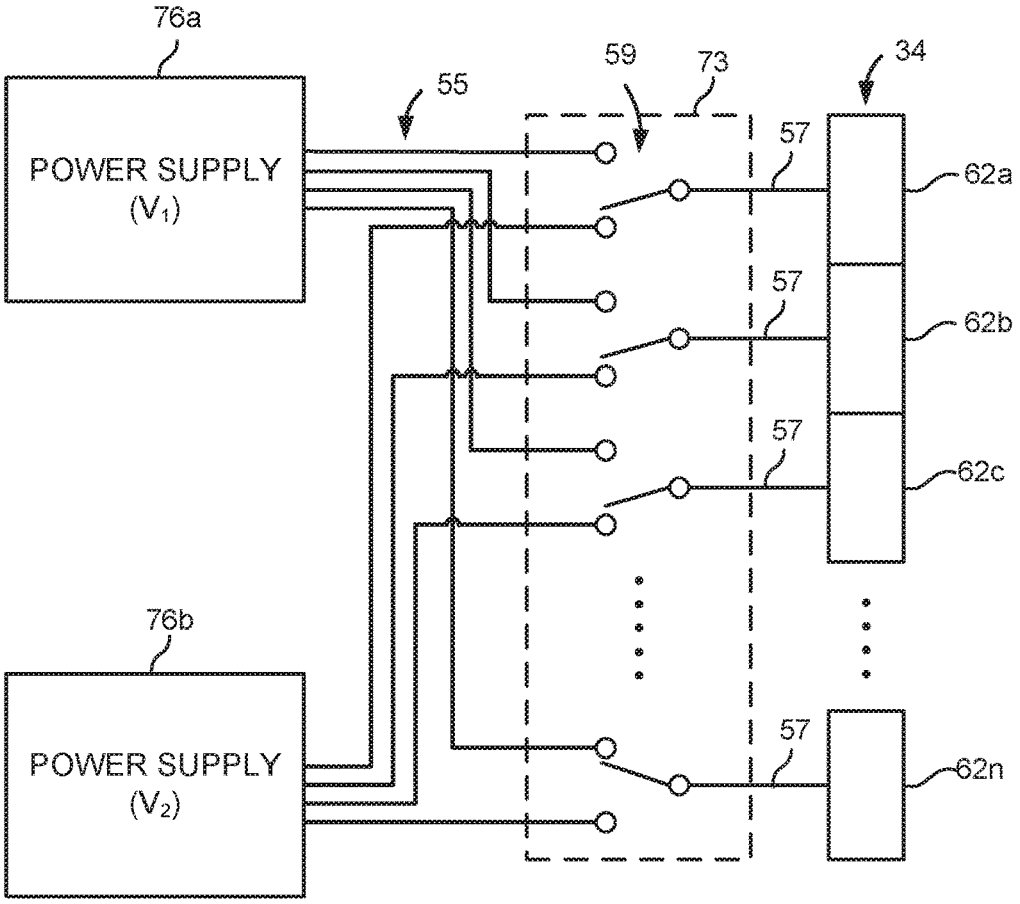
FIG. 8 schematically illustrates a switching assembly.

With reference now also to FIG. 8, in some examples the power supply 76 comprises two high-voltage power supply units 76*a*, 76*b* that supply two different voltages to the binary ink developer assembly via the switch assembly. For example, the first voltage may be for activating a segment of a member for printing and the second voltage may be for deactivating the segment of the member. Generally speaking, the first and second voltages may be in the range as described above, e.g., the first voltage may be a higher voltage in a range of 1000 V to 1500 V and the second voltage may be a lower voltage in the range of a range of 300 V to 600 V for supplying to individual electrode segments (or individual electrode segment pairs), the first voltage may be a higher voltage in a range of 600 V to 1000 V and the second voltage may be a lower voltage in a range of 300 V to 600 V for supplying to individual developer roller segments, or the first voltage may be a reduced voltage in a range of 300 V to 600 V and the second voltage may be a higher voltage of 800 V to 1100 V for supplying to segments of a squeegee roller. In the particular example shown in FIG. 8, where the developer roller 34 is segmented, the first voltage may be a higher voltage in a range of 600 V to 1000 V and the second voltage may be a lower voltage in a range of 300 V to 600 V.

The power supply units 76*a*, 76*b* may be provided as components within a unitary structure or as separate structures. Voltage lines 55 extend from the power supply units 76*a*, 76*b* to a set of switches 59. In some examples, and as shown, one switch 59 is provided for each segment 62 of the developer roller 34. This allows the voltage to the segments 62 of the developer roller 34 to be controlled on an individual basis. Furthermore, in some examples, each segment may be connected to two respective power supplies that provide the first and second voltages. A similar configuration as that shown in FIG. 8 may be provided for each member of the BID assembly 12 that is segmented.

In some examples, the power supply units 76*a*, 76*b* provide a continuous supply of voltages to switch assembly 73. The power supply units may be commercially available high-voltage power supply units as are known in the art. This has the benefit of reducing the amount of time to switch a segment from the first voltage to the second voltage. In other words, there is no need to build-up voltage for supply to the segments. This minimises the rise/fall time from one voltage to another voltage.

Figure 9:
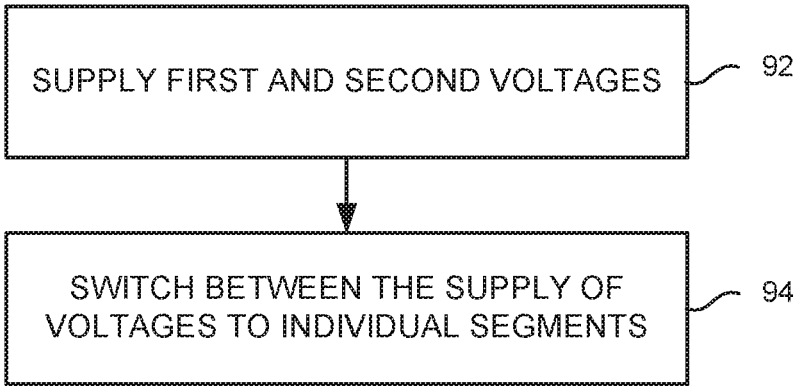
FIG. 9 is a flowchart of a process of switching voltage to individual segments.

A flowchart of a method of operating the LEP printing system 70 of FIG. 7 is shown in FIG. 9. At 92, first and second voltages are supplied to segments of a member of the BID assembly 12, for example as described above with reference to FIG. 8 above. At 94, the voltage supply to individual segments of the member is switched between the first and second voltages. This will be described in more detailed below with reference to FIGS. 10-12 in the context of one segmented member of the BID assembly 12. However, the principles described below can be readily extended to configurations in which two or more members of the BID assembly 12 are segmented.

Figure 10:
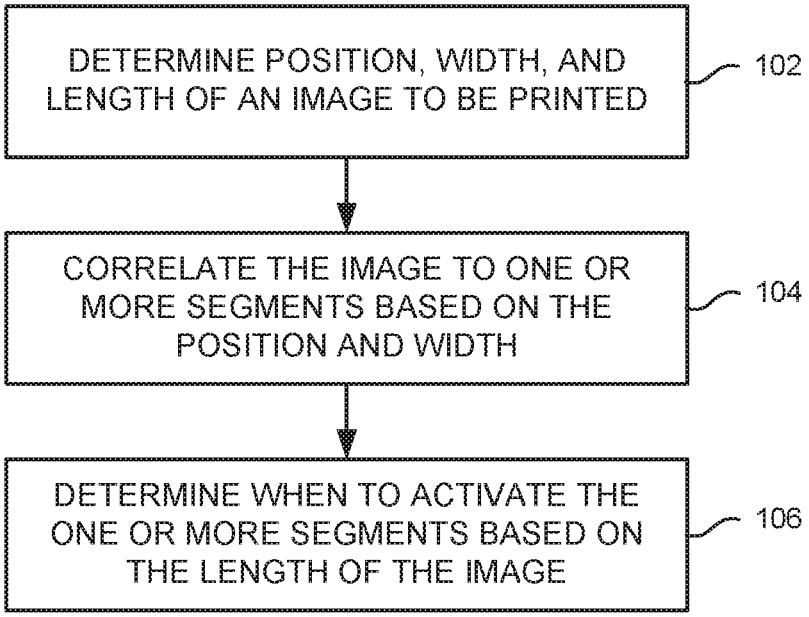
FIG. 10 is a flowchart of a process of determining a timing for activating segments for printing.

FIG. 10 is a flowchart of a process of determining which switches to activate for printing. At 102, properties of an image to be printed are determined. In examples, the properties comprise a location, a width, and a length of the image. These properties may be determined in terms of pixels, centimetres, inches, or any other suitable unit of measurement. The position may be determined in terms of X, Y coordinates or other spatial parameters. These properties may be defined with respect to a direction in which a medium in which the image is to be printed is fed through the LEP printing system. Thus, obtaining the properties may include obtaining print data about a print operation including, for example, print speed print size. However, this data may be known in advance. At 104, the position and width of the image is correlated to one or more segments of a member of BID assembly 12, i.e., to identify segments for deposing charged ink particles for printing the image. Thus, correlating the image may include obtaining system configuration data such as segment sizes and so on. This data may be known in advance. At 106, the length of the image is used to determine when to activate the one or more segments that were correlated to the image. Segments which are not used for printing the image may set to a deactivated state.

Figure 11A:
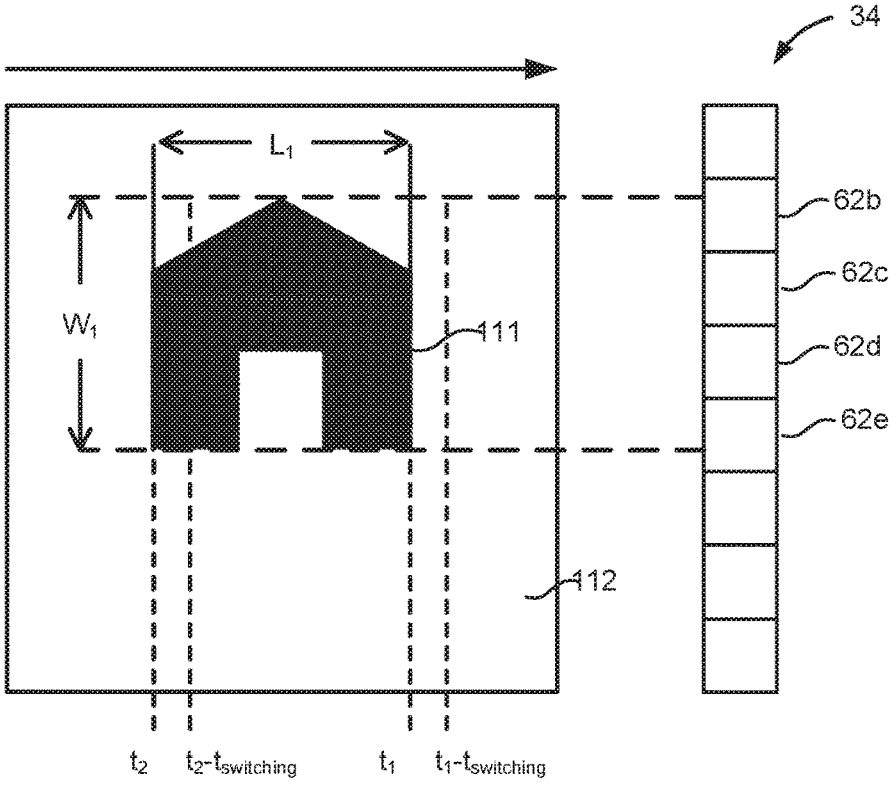
FIGS. 11A and 11B illustrate examples of analyzing an image to be printed.
Figure 11B:
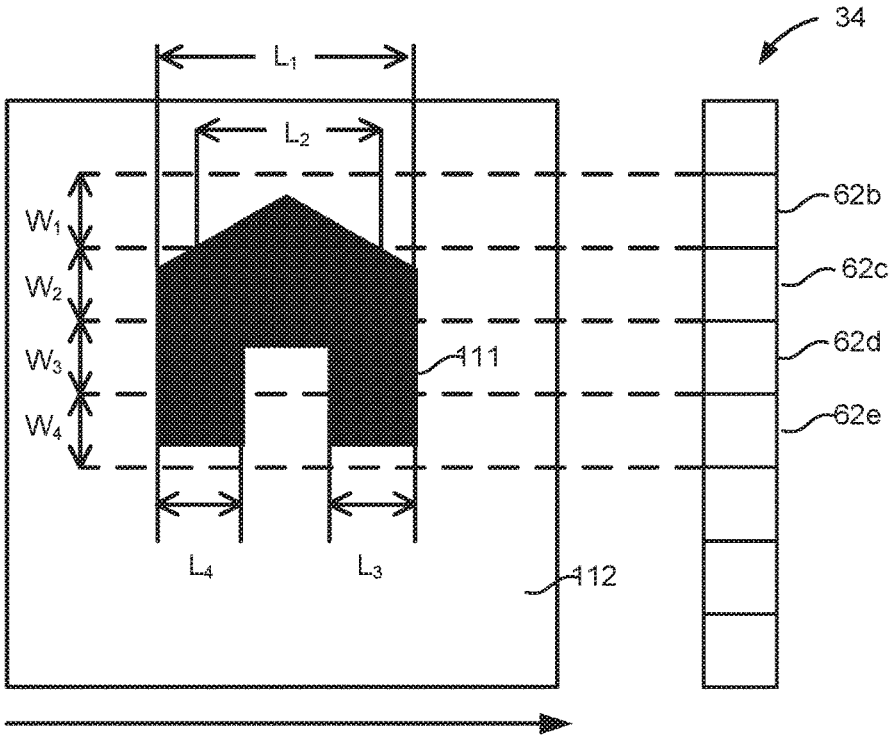
Figure 12:
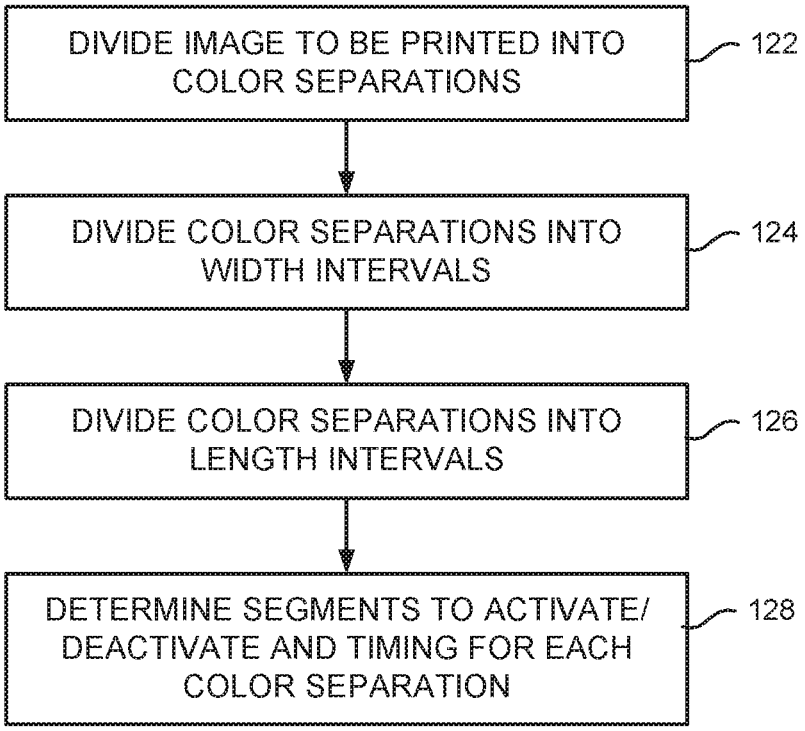
FIG. 12 is a flowchart of a process of determining a timing for activating segments for printing.

FIGS. 11A and 11B show an example of how to determine which switches to activate. As shown in FIG. 11A, an image 111 to be printed has a width $W_1$ (which may also be referred to as a width interval) and a length $L_1$ (which may also be referred to as a length interval), i.e., one width and one length are determined. The width $W_1$ is determined as the greatest extent of the image 111 in a direction perpendicular to a printing direction (which is indicated by the arrow); that is, the distance from uppermost and lowermost points of the image 111. Similarly, the length $L_1$ is the greatest extent of the image in the printing direction; that is, the distance from the rightmost point to the leftmost point. Based on the position and width of the image it can be determined that segments 62*b*-62*e* will need to be activated for the printing. In examples, the timing for activating segments 62*b*-62*e* is determined based on the length L1. For example, segments 62*b*-62*e* can be activated for printing on the print medium 112 between times $t_1$ and $t_2$. There may be a time delay between activating the segments and the transfer of charged ink particles to the print medium. This is indicated by $t_{switching}$. Similarly, there may be a time delay between deactivating the segments and halting the transfer of charged ink particles to the print medium. This is also indicated by the $t_{switching}$. Thus, the time for instructing a segment to be activated can be calculate as as $t_1-t_{switching}$ and $t_2-t_{switching}$ respectively (although it will be appreciated that the switching time for activating a segment may be different from the switching time for deactivating a segment). In examples, the switching time may be independent of the voltage value. The switching time can be determined based on the speed at which the printing medium is fed through the printing system, i.e., the printing speed, and the time taken for supply the appropriate voltage to the segment, i.e., the first voltage or the second voltage. For example, the switching time may be around 1 ms when a continuous supply of voltages and a switching assembly such as that shown in FIG. 8 are provided, compared to around 10 ms when voltages are built-up when no switching assembly is provided and voltages have to be built-up. The printing speed may be about 2000-3000 mm/s.

When the voltage to a segment of the developer roller is changed, i.e., when the segment of the developer roller is activated or deactivated, there will be a period of time before a steady-state voltage is reached. The effect of this is that the optical density of the charged ink particles on the print medium 112 may 'fade in' or 'fade out' when the segment of the developer roller is activated or deactivated, respectively. In particular, the fade in results from when the electric field which repels charged ink particles from the surface of the developer roller is changed to the electric field which attracts charged ink particles to the surface of the developer roller and which increases the particle density in an ink layer on the surface of the developer roller. The fade out results from when the electric field which attracts charged ink particles from the surface of the developer roller is changed to the electric field which repels charged ink particles to the surface of the developer roller and which decreases the particle density in an ink layer on the surface of the developer roller. By providing a continuous supply of voltages and a switching assembly such as that shown in FIG. 8, the period of time before the steady-state voltage is reached can be reduced and the fade in/fade out effects become less pronounced, compared to when no switching assembly is provided and voltages have to be built-up.

The width and length intervals of the image 111 to be printed can be determined on a more granular level. For example, as shown in FIG. 11B, the image 111 to be printed is divided into fourth width intervals $W_1$, $W_2$, $W_3$, and $W_4$ each corresponding to one of the segments 62*b*-62*e* that overlaps with the image 111 in the direction perpendicular to the printing direction. In examples, a length is determined for each width. For example, width interval $W_1$ may have an associated length interval $L_2$, width interval $W_2$ may have an associated length interval $L_1$ which is the same as that of FIG. 11A, width interval $W_3$ may have an associated length interval $L_1$, and width interval $W_4$ may have associated length intervals $L_3$ and $L_4$. Thus, segment 62*e* can be deactivated between two printing activations. In contrast, the segments 62*b*, 62*c*, 62*d* remain activated across their entire associated length intervals. The same principles of determining the timing commands that were described above with reference to FIG. 11A also apply to FIG. 11B, but these are not shown for reasons of clarity.

In the example shown in FIG. 11B, each width interval corresponds to one of the segments. Thus, a print area such as a page or portion of a page that includes the image to be printed may be divided into evenly spaced width intervals. Such width intervals can be on the pixel scale. Other configurations are possible. For example, the image to be printed may be divided into width intervals which are portions, or multiples (e.g., two or more), of the segments. Different combinations of width and length intervals are also possible.

The principles described above can be extended to dividing an image on a color-layer basis, by disabling segments that are not needed for printing a particular color layer. This is described with reference to the flowchart shown in FIG. 12. At 122, the image to be printed is divided into color separations. For example, the image may be divided into cyan, magenta, yellow, and black colors. Other colors are also possible. At 124 and 126, each of the color separations is divided into width and length intervals. This may be carried out in the same manner as described above with reference to FIGS. 11A and 11B. At 128, the segments that are to be activated/deactivated, and the timing for activating/deactivating the segments, are determined for each of the color separations based on the length and width intervals. This may also be carried out in the same manner as described above with reference to FIGS. 11A and 11B.

In the examples described above, two high-voltage power supplies continuously provide first and second voltages for activating and deactivating segments of a member of a BID assembly 12, and in particular for activating and deactivating segments 62 of the developer roller 34. However, it is possible that a different member of the BID assembly 12 is segmented. For example, it may be that the squeegee roller 42, as in FIG. 5, is segmented while other members of the BID assembly 12 are not segmented. Furthermore, it is possible that two or more members of the BID assembly 12 are segmented. For example, the BID assembly 12 may include the segmented electrode arrangement 38 of FIG. 3 in combination with the segmented developer roller 34 of FIG. 4. Each segmented member may be supplied with two voltages of different magnitudes, one for developing and one for non-developing, as described previously. Accordingly, each segmented member may be provided with a respective switching assembly and two respective high-voltage power supplies. For example, the BID assembly 12 may include a segmented developer roller 34, a segmented squeegee roller 42, a segmented cleaner roller 46, and segmented electrodes 38. In such a configuration, four pairs of power suppliers (eight in total) may be provided, two for the segmented developer roller 34, two for the segmented squeegee roller 42, two for the segmented cleaner roller 46, and two for the segmented electrodes 38. Furthermore, four switching assemblies may be provided, one for the segmented developer roller 34, one for the segmented squeegee roller 42, one for the segmented cleaner roller 46, and one for the segmented electrodes 38.

Figure 13:
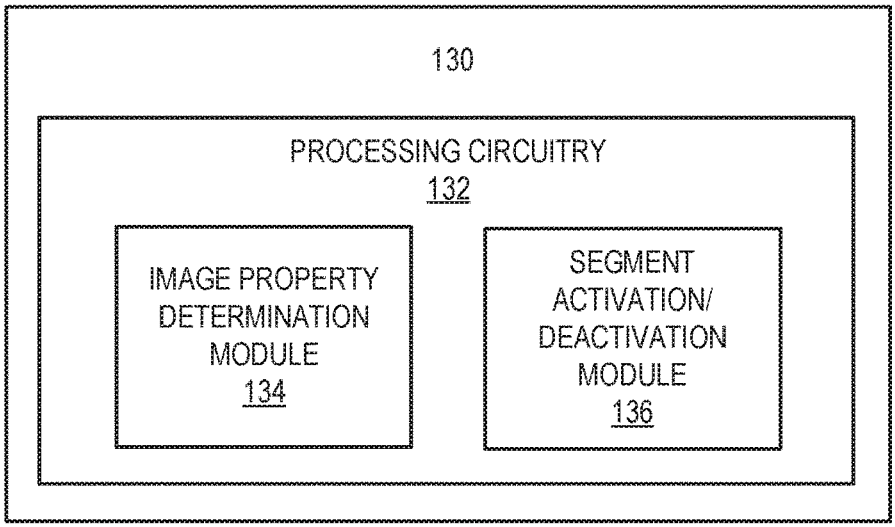
FIG. 13 is an example of a print control apparatus.

FIG. 13 is an example of an apparatus 130 comprising processing circuitry 132. In this example, the processing circuitry 132 comprises an image property determination module 134 and a segment activation/deactivation module 136. In use of the apparatus 130, the image property determination module 134 determines properties of an image to be printed such as a location, a width, and a length of the image. The segment activation/deactivation module 136 determines which segments to activate/deactivate and when. For example, the segment activation/deactivation module 136 may correlate the position and width of the image to one or more segments of a member of a BID assembly to identify segments for deposing charged ink particles for printing the image. As such, the apparatus 130 may be embodied as the controller 71 shown of FIG. 7, and the processing circuitry 132 may carry out the method of FIG. 10. Each of the modules 134, 136 may be provided by a processor executing machine-readable instructions.

Figure 14:
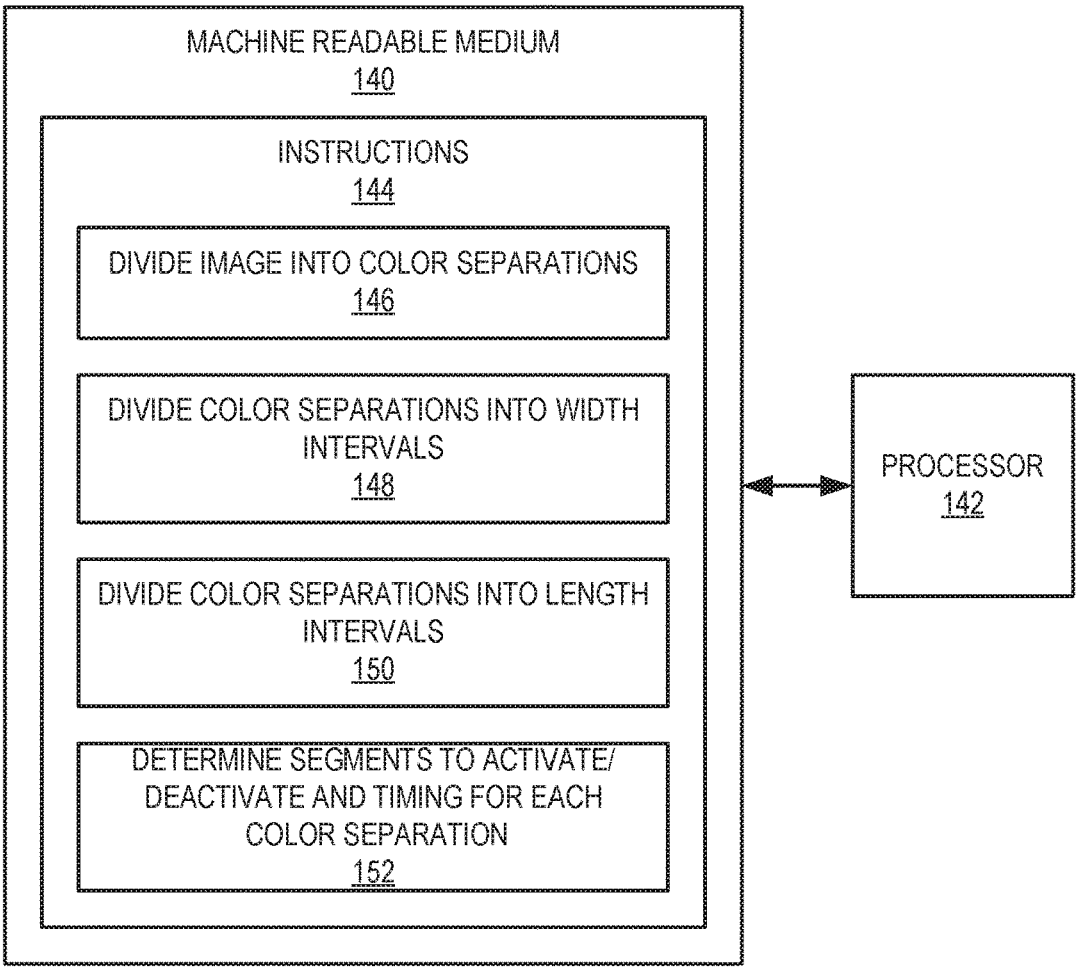
FIG. 14 is an example of a machine readable medium associated with a processor.

FIG. 14 is an example of a tangible, non-transitory, machine readable medium 1400 in association with a processor 142. The machine readable medium 140 stores instructions 144 which may be non-transitory and which, when executed by the processor 142, cause the processor 142 to carry out processes. The instructions 144 comprise instructions 146 to divide an image into color separations, instructions 148 to divide the color separations into width intervals, instructions 141 to divide the color separations into length intervals, and instructions 144 to determine which segments to active/deactive and when. Such instructions may comprise algorithms to devide and image into color separations, determine length and width intervals for the color separations, and determine segments, as described above with reference to FIG. 12.

In some examples, the instructions 144 may comprise instructions to cause the processor 142 to carry out at least one block of FIG. 10. In some examples, the instructions 144 may comprise instructions to cause the processor 142 to act as the modules of FIG. 13.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that various blocks in the flow charts and block diagrams, as well as combinations thereof, can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (such as the image property determination module 134 and the segment activation/deactivation module 136) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A liquid electro-photographic printing system, comprising:

a binary ink developer assembly including a plurality of members defining a flow path for a printing fluid containing charged particles, the plurality of members including a first member and a second member that are arranged to generate an electric field therebetween, the first member having a plurality of segments;

a power supply arrangement to continuously provide a supply of voltages during a print operation, the voltages including a first voltage from a first power supply unit and a second voltage, from a second power supply unit, having a different voltage level from that of the first voltage;

a switching arrangement to switch a connection to the segments of the first member on an individual segment basis between the first power supply unit and the second power supply unit, to cause charged particles to be attracted to the first member in the individual segment when the first voltage is supplied to the individual segment and to cause charged particles to be repelled from the first member in the individual segment when the second voltage is supplied to the individual segment; and a controller to determine a timing for switching the supply of voltages to the individual segment of the first member between the first and second voltages.

2. A liquid electro-photographic printing system according to claim 1, wherein the first member is one of: a developer roller, an electrode, and a squeegee.

3. A liquid electro-photographic printing system according to claim 1, wherein the timing based on a switching speed of the switching arrangement.

4. A liquid electro-photographic printing system according to claim 1, wherein the second member has plurality of segments, the voltages include a third voltage and a fourth voltage having a different voltage level from that of the third voltage, the switching arrangement is to switch the supply of voltages to the segments of the second member on an individual segment basis, to cause charged particles to be attracted to the second member in the individual segment when the first voltage is supplied to the individual segment and to cause charged particles to be repelled from the first member in the individual segment when the second voltage is supplied to the individual segment, and the controller is to determine a timing for switching the supply of voltages to the segments of the second member between the third and fourth voltages.

5. A liquid electro-photographic printing system according to claim 4, wherein the second member is one of: a developer roller, an electrode, and a squeegee.

6. A liquid electro-photographic printing system according to claim 1, wherein the segments are electrically insulated from each other.

7. A liquid electro-photographic printing system according to claim 1, further comprising an electrode with segments that correspond to the plurality of segments of the first member.

8. A liquid electro-photographic printing system according to claim 1, wherein the first member is a developer roller and further comprising a pair of opposing electrodes with segments that correspond to the plurality of segments on the developer roller.

9. A liquid electro-photographic printing system according to claim 1, wherein the segments are arranged as rings or partial ring segments of a conductive material.

10. A liquid electro-photographic printing system according to claim 1, wherein the segments of the plurality of segments have different widths.

11. A liquid electro-photographic printing system according to claim 1, wherein the first member is a squeegee roller.

12. A liquid electro-photographic printing system according to claim 1, wherein the segments are arranged in a row across a printing width of the printing system.

13. A liquid electro-photographic printing system according to claim 1, wherein the controller determines switching of the voltages to the individual segment based on whether a corresponding area of a photo imaging plate (PIP) is actively involved in a printing process.

14. A liquid electro-photographic printing system according to claim 1, wherein the first voltage is in a range from 600 V to 1500 V and the second voltage is in a range from 300 V to 600 V.

15. A print control apparatus, comprising:

a processor; and memory storing instructions which, when executed by the processor, cause the processor to:

determine a position, a width, and a length of an image to be printed, relative to a direction in which a print medium for receiving the image is fed through an liquid electro-photographic printing system having a binary ink developer assembly including a plurality of members defining a flow path for a printing fluid containing charged particles, the plurality of members including a first member and a second member that are arranged to generate an electric field therebetween, the first member having a plurality of segments, correlate the image to one or more of the segments based on the position and the width of the image, and determine a timing to activate the one or more segments for printing based on the length of the image.

16. A print control apparatus according to claim 15, wherein the instructions are further to cause the processor to issue a command to switch a voltage supply to the one or more segments from a first voltage that causes the one or more segments to be deactivated from printing to a second voltage that causes the one or more segments to be activated for printing.

17. A print control apparatus according to claim 16, wherein the first and second voltages are continuously supplied and the timing is based on the voltage switching time.

18. A print control apparatus according to claim 15, wherein the first member is a developer roller.

19. A print control method, comprising:

dividing an image to be printed into color separations;

dividing the color separations into width intervals and length intervals relative to a direction in which a print medium for receiving the image is fed through an liquid electro-photographic printing system having a binary ink developer assembly including a plurality of members defining a flow path for a printing fluid containing charged particles, the plurality of members including a first member and a second member that are arranged to generate an electric field therebetween, the first member having a plurality of segments; and for each color separation identifying one or more segments to activate based on the width intervals corresponding to the color separation, and determine activation timing and deactivation timing for the one or more segments based on the length intervals corresponding to the color separation.

20. A method according to claim 19, further comprising:

providing a supply of voltages during a print operation, the voltages including a first voltage and a second voltage having a different voltage level from that of the first voltage; and controlling the supply of voltages to the segments of the first member of the binary ink developer assembly, by switching between the first and second voltages on an individual segment basis, to attract charged particles to the member in an individual segment when the first voltage is supplied and repel charged particles to the member in the individual segment when the second voltage is supplied.

* * * * *